US009744432B2

(12) United States Patent
Vignati et al.

(10) Patent No.: US 9,744,432 B2
(45) Date of Patent: Aug. 29, 2017

(54) SNOWSHOE

(71) Applicants: Fabrizio Vignati, Milan (IT); Elio Tamanti, Turin (IT)

(72) Inventors: Fabrizio Vignati, Milan (IT); Elio Tamanti, Turin (IT)

(73) Assignee: VIGNATI LUIGI S.R.L., Assago (IT)

( * ) Notice: Subject to any disclaimer, the term of this patent is extended or adjusted under 35 U.S.C. 154(b) by 158 days.

(21) Appl. No.: 14/399,976

(22) PCT Filed: May 23, 2013

(86) PCT No.: PCT/IT2013/000147

§ 371 (c)(1),
(2) Date: Nov. 10, 2014

(87) PCT Pub. No.: WO2013/179325

PCT Pub. Date: Dec. 5, 2013

(65) Prior Publication Data

US 2015/0121725 A1 May 7, 2015

(30) Foreign Application Priority Data

May 28, 2012 (IT) ..... CR2012A0012

(51) Int. Cl.
*A63C 13/00* (2006.01)

(52) U.S. Cl.
CPC ..... *A63C 13/003* (2013.01)

(58) Field of Classification Search
CPC ..... A41B 3/18; A41D 27/16
USPC ..... 2/129; 36/126
See application file for complete search history.

(56) References Cited

U.S. PATENT DOCUMENTS 2,410,702 A * 11/1946 Arsenault ..... A63C 13/001 280/603
3,861,698 A * 1/1975 Greig ..... A63C 9/00 280/604
5,884,933 A * 3/1999 Trott ..... A63C 5/03 280/14.22

(Continued)

FOREIGN PATENT DOCUMENTS

DE 20 2012 001536 6/2012
EP 1 123 721 8/2001

(Continued)

OTHER PUBLICATIONS

Espacenet Translated. German to English Machine translation of Schloegl DE 202012001536. translated Jun. 8, 2016.*

(Continued)

*Primary Examiner* — Nathan Durham
*Assistant Examiner* — Anne Kozak
(74) *Attorney, Agent, or Firm* — Young & Thompson

(57) ABSTRACT

A snowshoe (1) for mountain winter sports includes:
a plate (2) for resting on the snow and distributing a user's weight, having an upper face (2') and a lower face (2");
elements for fixing, at least partially, the user's foot to the upper face (2') of the plate (2); and
a plurality of spikes (3),
where the plate (2) includes a mobile structure (4) adapted to make the plurality of spikes (3) alternately available below the lower face (2") of the plate (2), so as to define an uphill and a downhill configuration.

20 Claims, 7 Drawing Sheets

(56) References Cited

U.S. PATENT DOCUMENTS

| | | | | |
|---|---|---|---|---|
| 7,080,850 | B2 * | 7/2006 | Ekberg | A63C 5/00 280/20 |
| 7,150,464 | B2 * | 12/2006 | Ekberg | A63C 13/003 280/601 |
| 8,925,956 | B1 * | 1/2015 | Harkin | A63C 13/003 280/604 |
| 9,079,094 | B2 * | 7/2015 | Ekberg | A63C 9/00 |
| 9,238,168 | B2 * | 1/2016 | Kloster | A63C 5/02 |
| 2001/0038192 | A1 * | 11/2001 | McManus | A63C 5/02 280/601 |
| 2002/0017771 | A1 * | 2/2002 | McManus | A63C 5/02 280/600 |
| 2004/0021297 | A1 * | 2/2004 | Ekberg | A63C 5/00 280/600 |
| 2007/0079529 | A1 * | 4/2007 | Ekberg | A63C 5/02 36/122 |

FOREIGN PATENT DOCUMENTS

| | | |
|---|---|---|
| FR | 2 792 540 | 10/2000 |
| WO | 2007/044846 | 4/2007 |

OTHER PUBLICATIONS

International Search Report dated Oct. 18, 2013, corresponding to PCT/IT2013/000147.

* cited by examiner

SNOWSHOE

BACKGROUND OF THE INVENTION

The invention relates to the mountain winter sports equipment sector, and in particular to a snowshoe.

DESCRIPTION OF THE RELATED ART

Snowshoes are instruments that enable the user to move easily on foot over fresh snow since they increase the surface area on which the foot walks and thereby prevent sinking or slipping, and enable a sort of "floating".

Each snowshoe essentially consists of a plate adapted to distribute the weight of the user over a wide surface, so as to reduce the pressure exerted on the snow.

The snowshoe is also fitted with means for fixing the user's foot to said plate, a sort of articulated binding that allows the user to walk in a fairly natural manner even on uphill slopes.

It is also very important that the snowshoe is fitted with a plurality of metal spikes, which protrude from the lower face of the plate, the face turned towards the ground, and give better grip on snow and ice, better control of the walking action and safer stopping when the snowshoes are used for walking downhill.

Often on downhill sections, it is preferable to replace snowshoes with skis, thereby alternating the two types of movement, and the relative equipment, based on the slope and difference in altitude of the ground along the course of the chosen route, resulting in greater satisfaction and fun, and also reducing the time taken for the descent.

However, this twin solution leads to the disadvantage of always having to carry two sets of equipment and, therefore, of having to wear snowshoes for the uphill sections, while carrying the skis on one's shoulders, fixed to one's rucksack, and then switching for downhill sections.

Disadvantageously, the weight and size of the two sets of equipment makes walking in snow harder and more demanding.

Furthermore, changing equipment takes time and, considering the temperatures encountered on the snow, it can be unpleasant having to stop in the cold.

SUMMARY OF THE INVENTION

The aim of the present invention is to provide a functional snowshoe, which can be easily adapted and modified to be usable both when walking uphill in the mountains and when walking downhill, in the latter case by simulating the sliding movement typical of skis.

A further aim of the present invention is to provide a snowshoe that is strong yet light, practical and easy to use.

These aims are achieved by a snowshoe comprising:

- a plate for resting on the snow and distributing a user's weight, having an upper face e a lower face;
- means for fixing, at least partially, the user's foot to the upper face of said plate;
- a plurality of spikes, characterized in that said plate comprises a mobile structure adapted to make said plurality of spikes alternately available below the lower face of said plate, so as to define an uphill and a downhill configuration.

According to a first possible embodiment of the invention, said plurality of spikes is firmly associated with the lower face of said plate and said structure is adapted to cooperate with the upper face or lower face of said plate respectively, so as to reversibly cover said plurality of spikes.

In particular, said structure comprises a smooth face and a shaped face for housing said plurality of spikes.

Advantageously, said structure comprises two strips arranged along the longitudinal edges of its smooth face.

According to a further possible embodiment of the invention, said lower face of said plate is smooth and said plurality of spikes is firmly associated with said structure adapted to cooperate with the upper face and the lower face of said plate respectively, so as to make alternately available said plurality of spikes.

In a particularly preferred embodiment of the invention, said plate comprises a central portion for resting stably on the snow and two side wings raised with respect to said central portion.

Advantageously, said plate comprises two strips arranged along the longitudinal edges of said central portion and further two strips arranged along the longitudinal edges of said side wings.

According to a first embodiment of the invention, said structure is associated with said plate by means of hinge means.

In particular, said hinge means have a variable axis of rotation.

According to a further embodiment of the invention, said hinge means comprise a slot associated with said plate and a pin associated with said structure, wherein the variable position of said axis is defined by said pin moving within said slot.

According to a preferred embodiment of the invention, said hinge means affect the front part of said plate, and said structure has a substantially U-shape conformation.

In particular, according to an even more preferred embodiment, said U-shape structure comprises two arms and a connecting portion, wherein between each of said arms and said connecting portion there is an interposed hinge with a vertical axis, adapted to allow the rotation in a substantially horizontal plane of the relative arm in order to open it with respect to its operating position.

Advantageously, between said arms and said connecting portion there are interposed further rotation limitation means, which in particular comprise a fixed tooth firmly associated with said connecting portion and a rack firmly associated with the respective arm.

According to another embodiment of the invention, said snowshoe comprises restraining means for reversibly fixing said structure to said plate.

In particular, said restraining means comprise:

- a tooth associated with said structure;
- a first and a second flexible ratchet associated with said plate, adapted to cooperate with said tooth when said structure cooperates respectively with said upper face or said lower face of said plate.

The main advantage of the snowshoe according to the invention lies in its maximum functionality: in fact, the snowshoe can be used both when going uphill, using the plurality of spikes to grip the snow, and when going downhill, by sliding on the smooth surface provided by the suitable mobile structure as an alternative to the spikes.

According to the first variant of the invention, the surface of the smooth face of the structure allows sliding when going downhill, while its shaped face advantageously covers the spikes provided below the plate.

The shape of the structure, where the spikes are housed when going downhill, compensates for the protruding thickness of the spikes themselves, ensuring that the snowshoe has a lower surface that is completely smooth and closed, perfect for sliding.

In the same way, in the second embodiment of the invention, the plate of the snowshoe has a well-defined smooth area, and it is instead the structure that supports the spikes and makes them available only for the uphill configuration.

In this particular embodiment, the conformation of the plate with different levels is also very advantageous, where the central portion thereof, with a narrow elongated shape similar to that of a ski, favors the sliding of the snowshoe in the normal downhill configuration, precisely when a narrow shape is preferred, but at the same time the side wings ensure its stability when rotating, for example on bends or turns.

The strips provided on the snowshoe, described in both embodiments, whether associated with the structure or with the plate, are useful in the downhill configurations, as they guarantee the snowshoe the maximum stability and grip, without reducing the amount of slide and therefore the amount of fun for the user.

Advantageously, said mobile structure is always applied to the plate of the snowshoe, being rotatably associated therewith, so as to cooperate with its upper face or its lower face without constituting an extra, separate element, which would only create an awkward bulk.

The hinge means by which said plate and said structure are connected have a variable axis of rotation to guarantee the perfect adhesion of the two parts in both operating configurations, and so as not to leave free areas or openings where the snow could get in and, freezing, would compromise the equilibrium or the sliding of the snowshoe.

Even more advantageously, said hinge means are placed at the front of the snowshoe, near the tip, thereby guaranteeing the minimum bulk and the maximum functionality.

Furthermore, the structure's U-shape allows rotation thereof around the hinge means without any need to release the foot from the snowshoe, thereby further speeding up operations to change the configuration.

To make rotation of the mobile structure around the plate even easier and more practical, without any need for the user to release his/her boot from the snowshoe, in one possible embodiment, the arms that constitute the structure's U-shape conformation are rotatingly associated with its connecting portion and can therefore open outwards, increasing their distance, to facilitate the step-over of the user's leg and boot.

For greater safety, the snowshoe is also provided with means for restraining the structure to the plate, which operates both in the uphill and downhill configuration, so as to hold the two parts together and avoid accidental uncoupling.

BRIEF DESCRIPTION OF THE DRAWING FIGURES

These and other advantages will become more apparent from the following description or preferred embodiments of the invention, which is illustrated by no way of limitation in the accompanying drawings, in which.

DETAILED DESCRIPTION OF THE INVENTION

With reference to the Figures, the snowshoe 1 substantially comprises a plate 2, generally made of plastic, to be positioned under the user's foot, for resting on the snow and distributing his/her weight over a wide surface area.

Said plate 2 has an upper face 2' and a lower face 2".

Said upper face 2' is provided with known means for fastening the user's foot. Particularly advantageous embodiments of the invention envisage the user being able to wear normal footwear or trekking boots and said fastening means being of a type similar to the known bindings used on snowboards, thereby ensuring the maximum safety and protection for the user's foot, and the maximum versatility of the snowshoe itself.

On the lower face 2" of said plate 2, said spikes 3 are alternately made available depending on the operating configuration required, for uphill or downhill use.

To that end, said plate 2 comprises a mobile structure 4 adapted to make available said plurality of spikes 3 below the lower face 2" of said plate 2 to define a first uphill configuration, and to make said spikes unavailable in a second downhill configuration.

With particular reference to FIGS. 1-9, a first embodiment of the snowshoe 1 according to the invention is shown.

The spikes 3 are firmly associated with the lower face 2" of said plate 2, and are mainly distributed in the median side portions 2"*a*, where they protrude so that they can stick into the snow and provide grip when walking uphill, thereby preventing the foot from slipping.

The plate 2 also comprises a structure 4, associated therewith and adapted to cooperate with its upper face 2' or lower face 2" respectively.

Said structure 4 is needed to reversibly cover said plurality of spikes 3 with its thickness compensating for their protrusion.

With particular reference to FIGS. 1-5, a snowshoe 1 is shown in a first operating configuration for walking uphill in the mountains in the snow, wherein said structure 4 cooperates with the upper face 2' of said plate 2.

Figure 1:
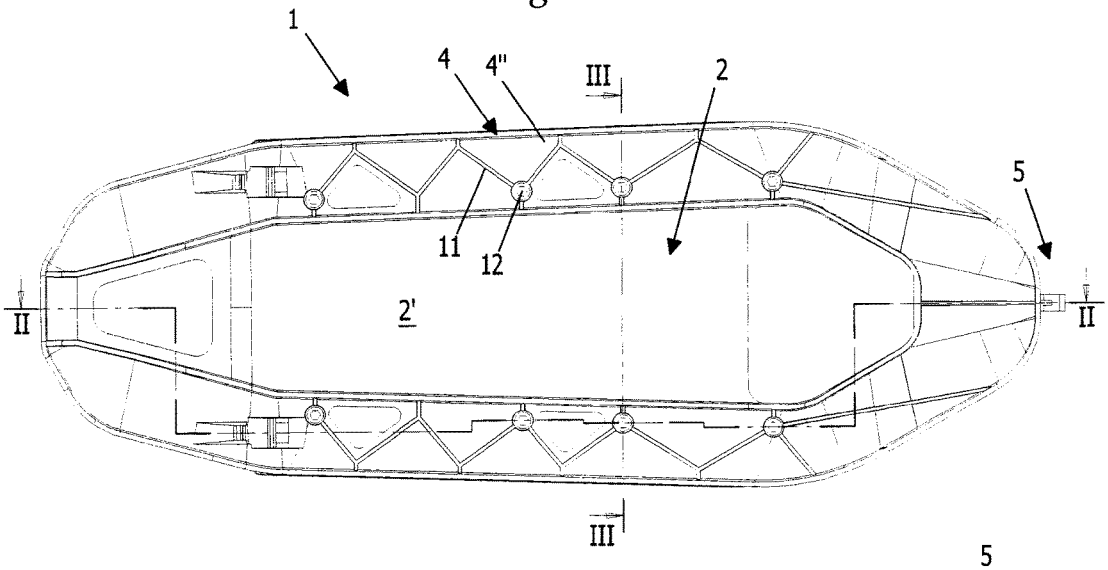
FIGS. 1-5 show, respectively, an overhead plane view, a longitudinal and transversal cross-section view, a side view and a front view of a snowshoe according to a first embodiment of the invention and in a first operating configuration, particularly for uphill use.
Figure 2:
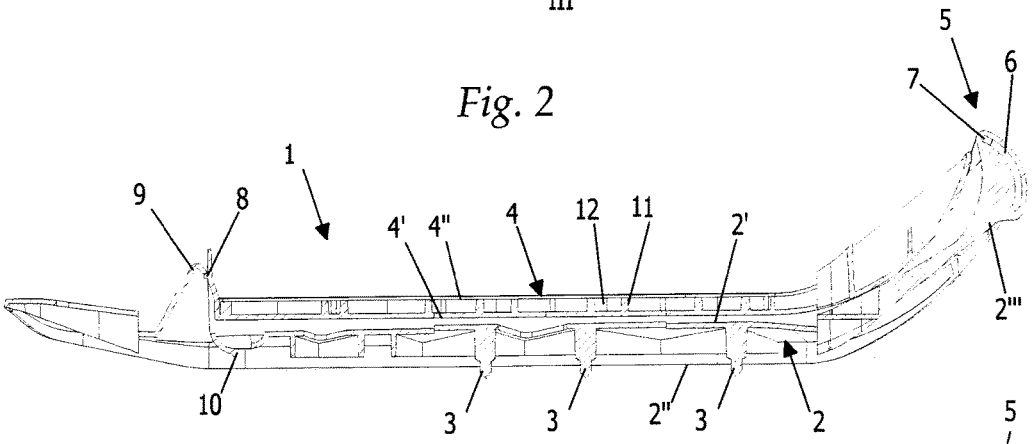
Figure 4:
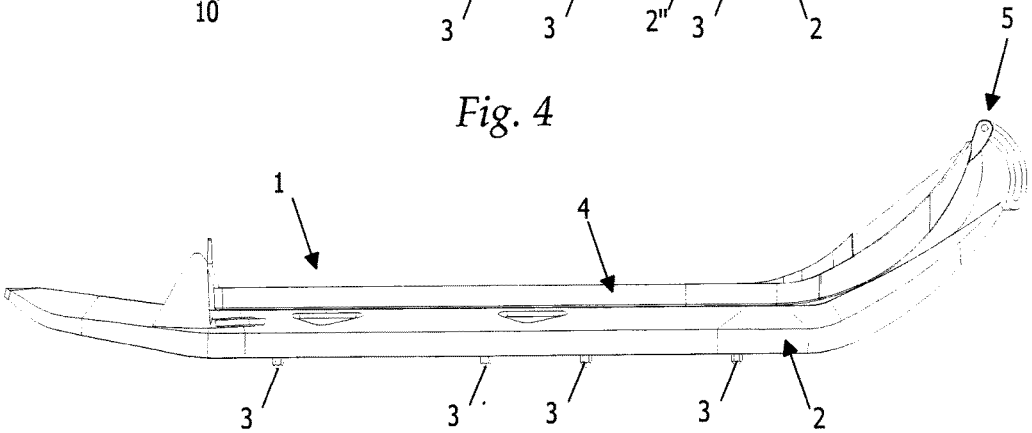
Figure 3:
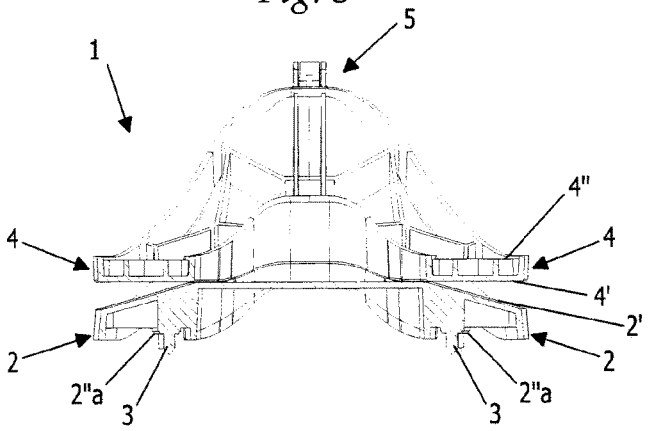
Figure 5:
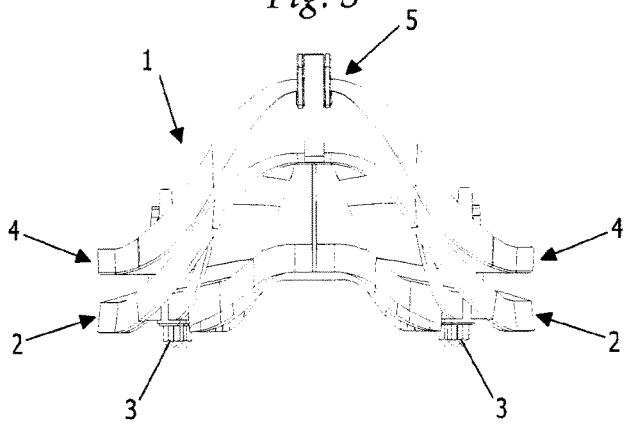
Figure 6:
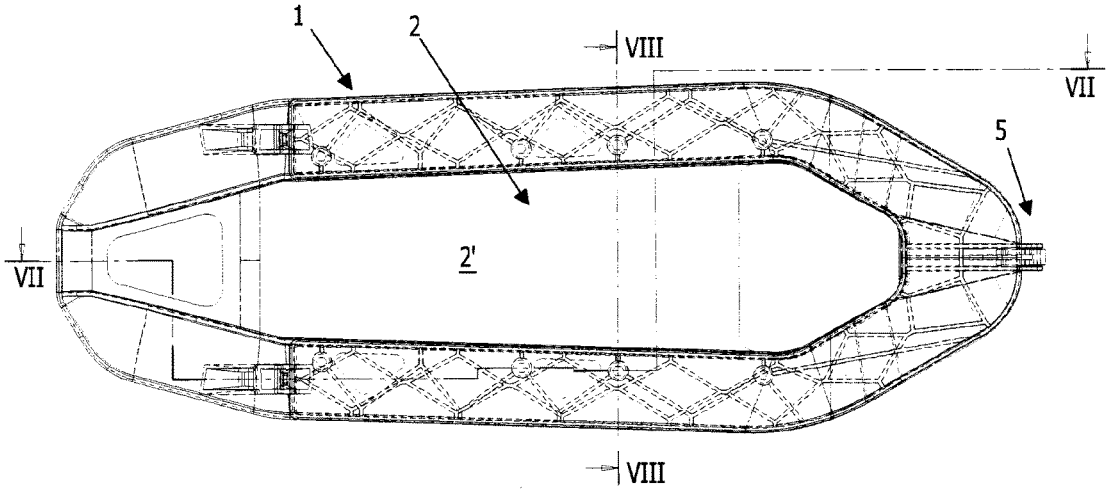
FIGS. 6-8 show, respectively, a top plane view, a partial sectioned side view and a cross-section view of a snowshoe according to a first embodiment of the invention and in a second operating configuration, particularly for downhill use.
Figure 7:
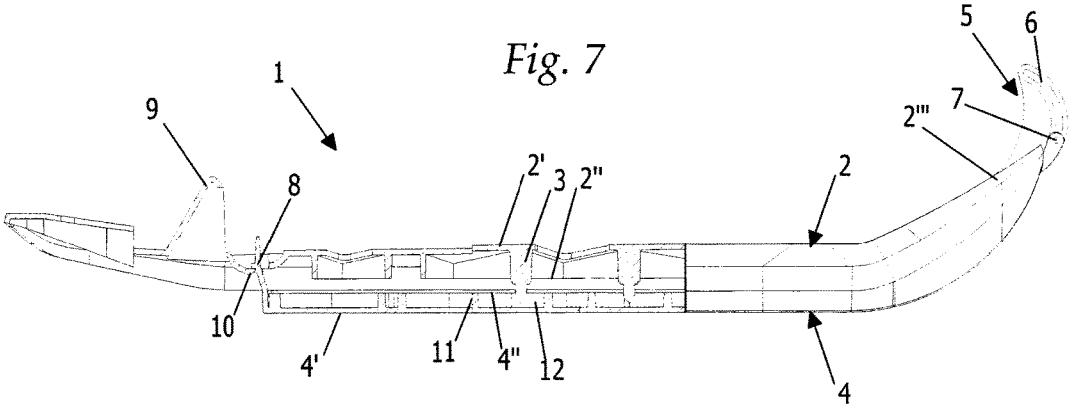
Figure 8:
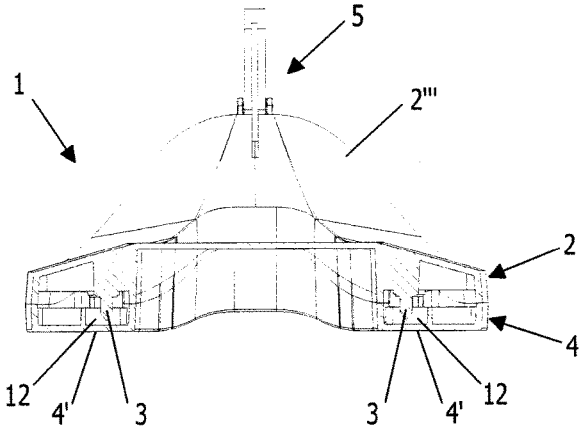

With particular reference to FIGS. 6-8, the same snowshoe 1 is shown, in a second operating configuration for walking downhill in the mountains in the snow, wherein said structure 4 this time cooperates with the lower face 2" of said plate 2.

Said structure 4 therefore comprises a smooth face 4' and a shaped face 4" with ribs 11 that define housings 12.

Said smooth face 4' cooperates with the upper face 2' of the plate 2 in the uphill configuration, while it constitutes the sliding surface in the downhill configuration.

Said shaped face 4" with ribs 11, faces upwards in the uphill configuration, while it is in contact with the lower face 2" of the plate 2 in the downhill configuration. In the latter case, the plurality of spikes 3 is contained in housings 12 and the thickness of the structure 4 entirely compensates for their protrusion.

Said structure 4 has a substantially U-shape conformation and is rotatingly associated with said plate 2 by means of hinge means 5 placed near the tip 2'" of the plate.

The U-shape of the structure 4 ensures complete coverage of the spikes 3.

Figure 9:
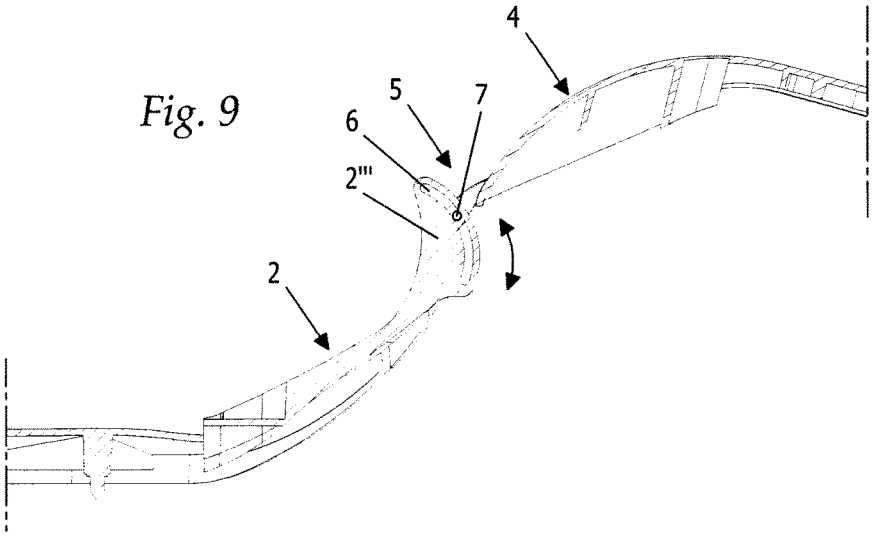
FIG. 9 shows a partial longitudinal cross-section and a detail of the snowshoe shown in FIGS. 1-8, in the switch from the first operating configuration to the second.
Figure 10:
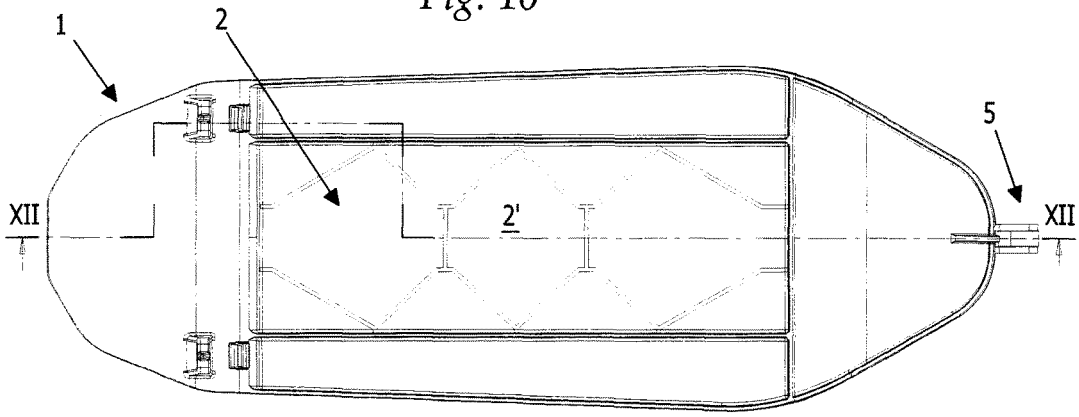
FIGS. 10-13 show, respectively, a top plane view and view from below, and a longitudinal and cross-section view of a second embodiment of the snowshoe, in the first operating configuration, i.e. for uphill use.
Figure 11:
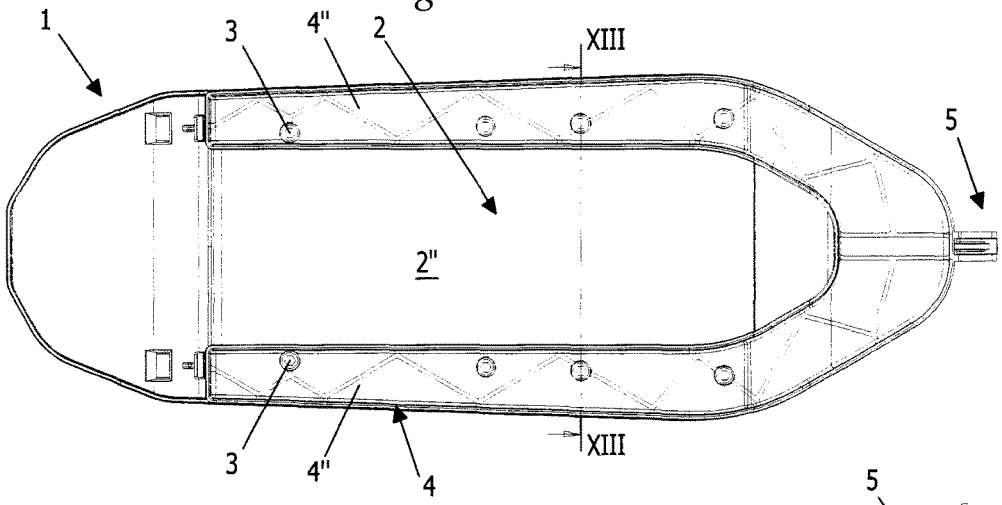
Figure 12:
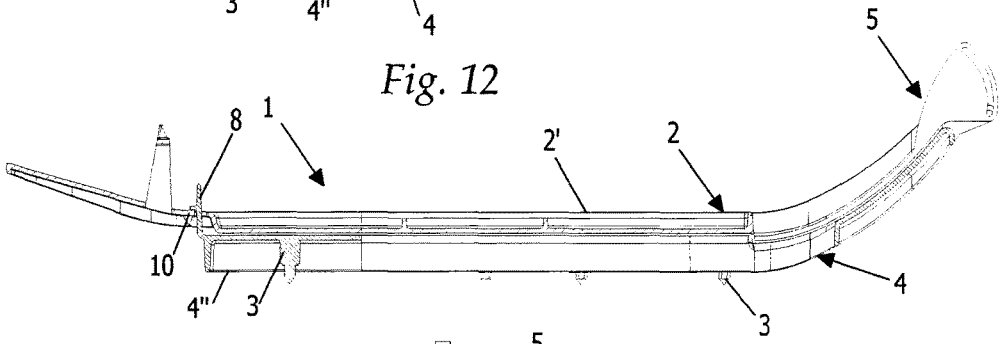
Figure 13:
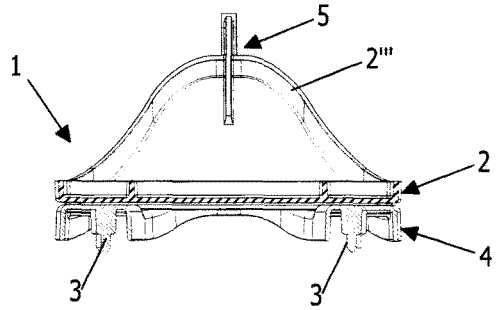
Figure 14:
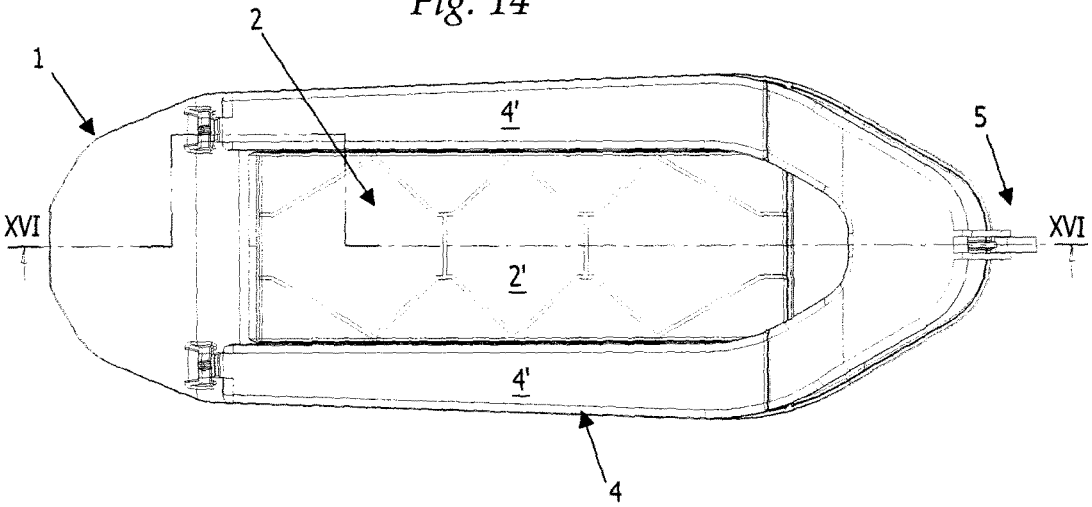
FIGS. 14-17 show, respectively, a top plane view and view from below, and a longitudinal and cross-section view of a second embodiment of the snowshoe, in the second operating configuration, i.e. for downhill use.
Figure 15:
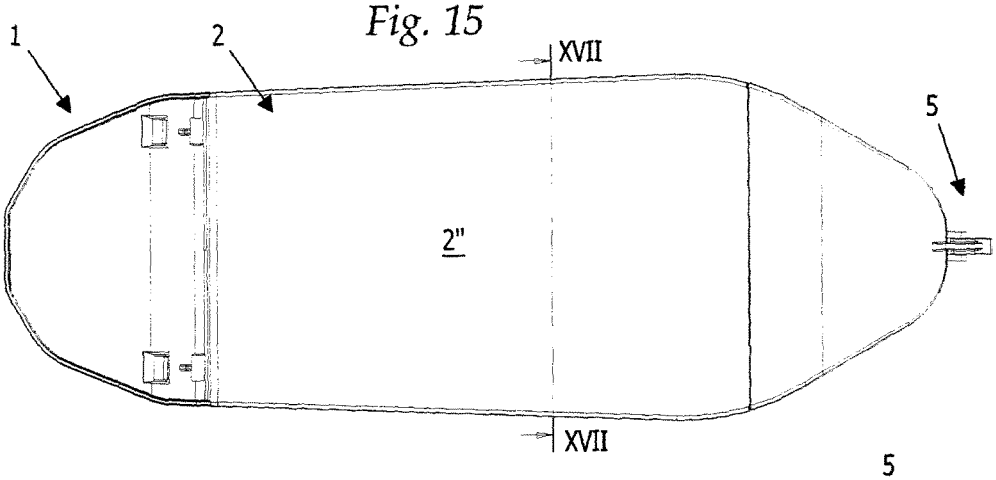
Figure 16:
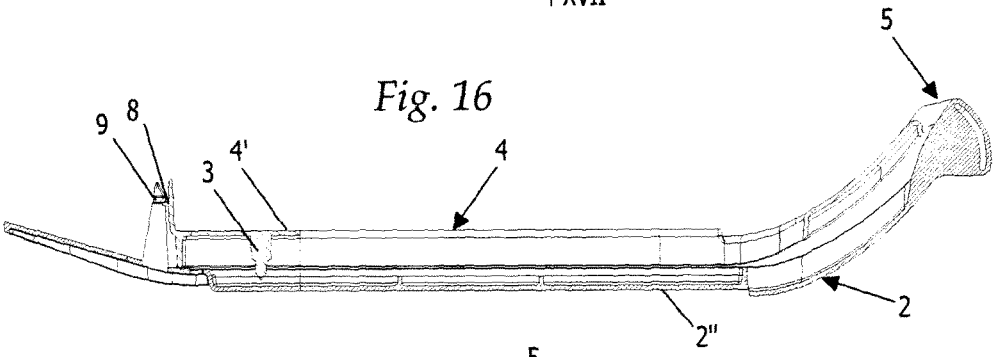
Figure 17:
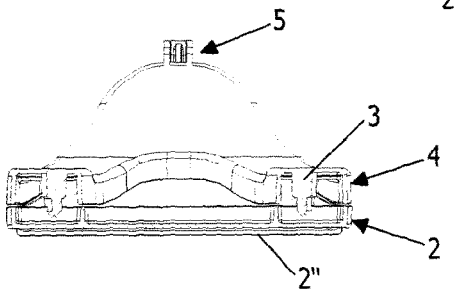

To enable the switch from said first uphill configuration to said second downhill configuration, said structure 4 turns about said hinge means 5, as shown in FIG. 9.

In particular, said hinge means 5 have a variable axis of rotation, which can be raised or lowered to enable, upon completion of the rotation, the structure 4 and the plate 2 to be always in contact with one another.

Said hinge means 5 comprise a slot 6 associated with said plate 2 and a pin 7 associated with said structure 4.

The variable position of said axis is defined by said pin 7 which engages said slot 6 and can move therewithin to take up either of the two end positions, respectively when the structure 4 and the plate 2 are in contact with one another in the two operating configurations for the snowshoe 1.

With particular reference to FIGS. 10-17, a second embodiment of the snowshoe according to the invention is shown, wherein the lower face 2" of said plate 2 is smooth and the spikes 3 are instead firmly associated with the mobile structure 4 and turn with it.

In this case, too, the mobile structure 4, in fact, is adapted to cooperate respectively with the upper face 2' and the lower face 2" of said plate 2 so as to make alternately available said plurality of spikes 3 depending on the operating configuration required by the user, for uphill or downhill use.

Figure 18:
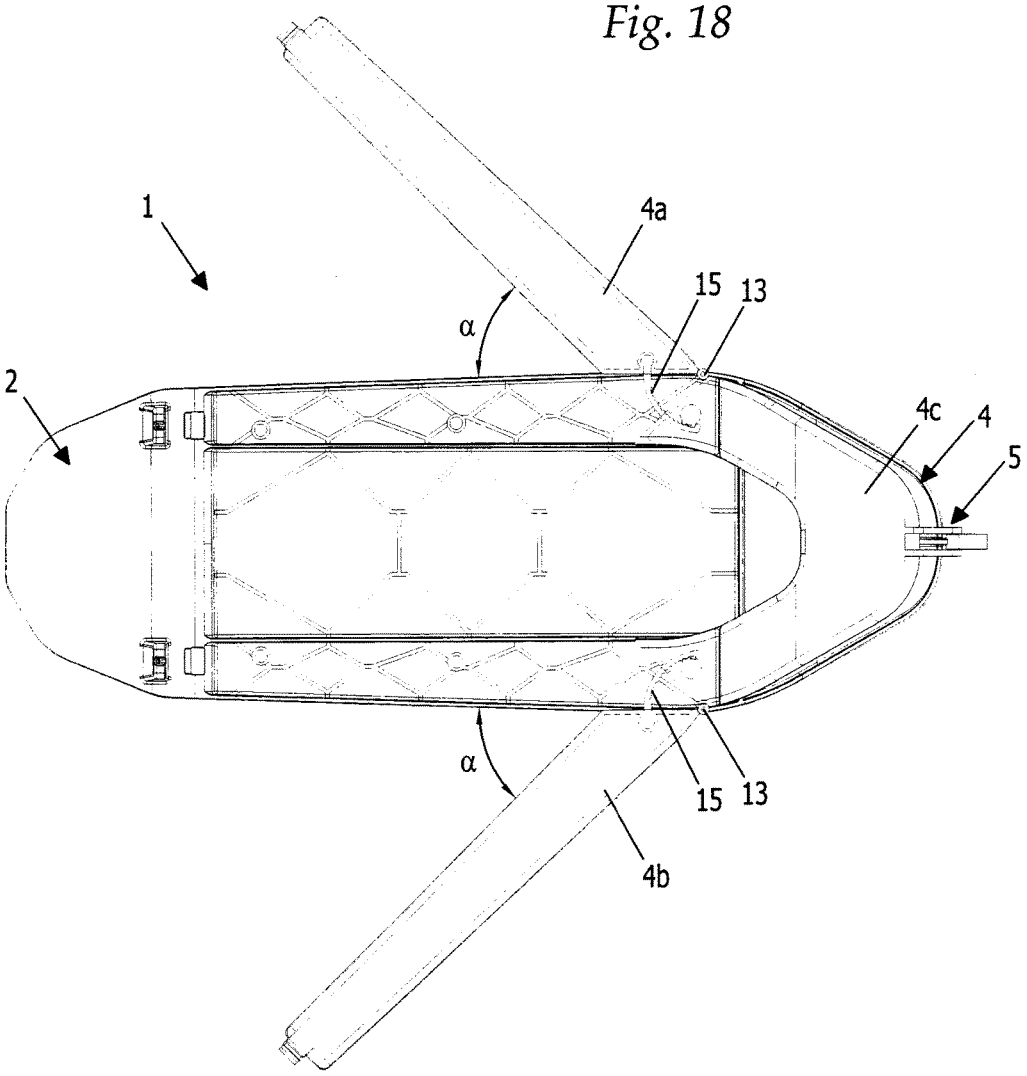
FIGS. 18 and 19 show, respectively, a top plane view and a detail of the snowshoe according to a particular, more functional embodiment than that shown in FIG. 15.
Figure 19:
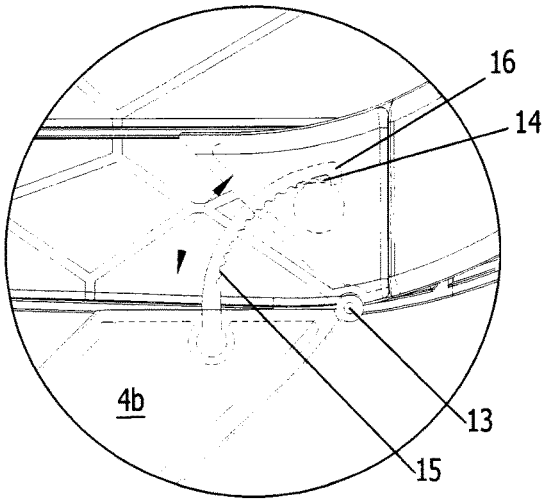

FIGS. 18 and 19, on the other hand, show an embodiment of the snowshoe 1 that makes it particularly functional and practical.

Advantageously, said U-shape structure 4 comprises two arms 4*a* and 4*b* and a connecting portion 4*c*, and between each of said arms 4*a*, 4*b* and said connecting portion 4*c* there is an interposed hinge 13 with a vertical axis, adapted to allow the rotation in a substantially horizontal plane of the relative arm in order to open it with respect to its operating position.

Near each hinge 13, between said arm 4*a*, 4*b* and said connecting portion 4*c*, there are also interposed rotation limitation means, so as to allow an opening of the arm to an angle $\alpha$ equivalent to a maximum of around 45°.

As shown in detail in FIG. 19, said limitation means comprise a fixed tooth 14 firmly associated with said connecting portion 4*c* and a rack 15 firmly associated with the respective arm 4*a* or 4*b*.

Said rack 15 ends with a blocking element 16 to define the maximum opening angle $\alpha$.

In all the embodiments shown, said snowshoe 1 also comprises restraining means for holding said structure 4 safely to said plate 2.

Said restraining means comprise a tooth 8 protruding from said structure 4, a first flexible ratchet 9 and a second flexible ratchet 10 provided on said plate 2.

Said first ratchet 9 cooperates with said tooth 8 when said structure 4 is in contact with the upper face 2' of said plate 2, while said second ratchet 10 cooperates instead with said tooth 8 when said structure 4 is in contact with the lower face 2" of said plate 2.

Figure 20:
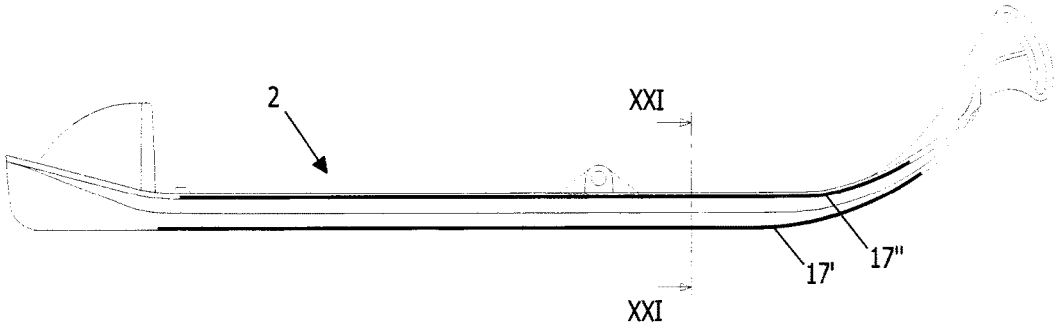
FIGS. 20 and 21 show, respectively, a side view and cross-section view of a component of the snowshoe in a particular version of the embodiment shown in FIGS. 10-17.
Figure 21:
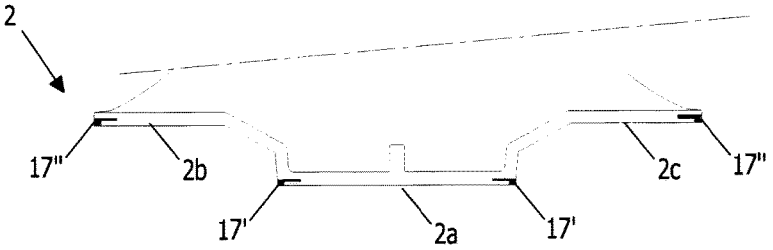

FIGS. 20 and 21 show a further embodiment of the snowshoe 1 which is particularly functional and practical when walking downhill.

The plate 2 that constitutes the snowshoe 1 is shaped with two levels.

On a first level, said plate 2 comprises, in fact, a long narrow central portion 2*a*, adapted to ensure a stable support for the snowshoe 1 on the snow when walking downhill and in a straight line.

To the sides of said central portion 2*a*, placed on a second level and raised with respect to it, two side wings 2*b* and 2*c* are provided, the edge of which acts as a support on bends and sharp turns when walking downhill, when the snowshoe 1 needs to be slightly inclined with respect to the plane of the snow on which only the central portion 2*a* normally rests.

Along the longitudinal edges of said central portion 2*a* and of said side wings 2*b* and 2*c* metal strips 17' and 17" are provided, which help the snowshoe 1 to grip the frozen snow in bends and when braking.

Figure 22:
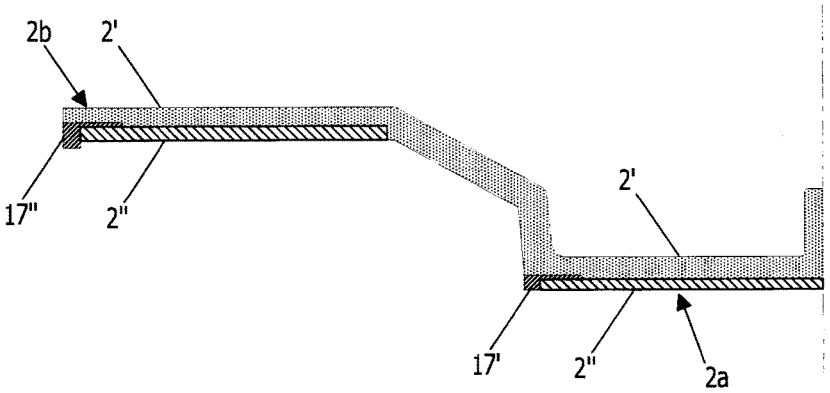
FIG. 22 shows a cross-section view of a detail of FIG. 21, with proportions that have been deliberately altered for the sake of clarity.

Said strips 17' and 17", as demonstrated by the detailed stratigraphy shown in FIG. 22, have different thicknesses: the strips 17' provided on the edges of the central portion 2*a* are contained within the thickness of that portion 2*a* of the plate 2 and have a thickness of around 2 mm, for example, while the strips 17" provided on the edges of the side wings 2*b* and 2*c* have a thickness of around 2.5 mm, for example, and protrude towards the snow by around 0.5 mm from the thickness of the side wings 2*b* and 2*c* of the plate 2, so as to further improve the downhill performance of the snowshoe 1.

Still with particular reference to the section shown in FIG. 22, the composition of the plate 2 that constitutes the snowshoe 1 is shown.

The material used is a co-pressed element made of two coupled materials that also hold said strips 17', 17" along the edges in a sandwich configuration.

In particular, the face 2" of the plate 2, which when in use and when sliding is turned towards the snow, is made of high-density polyethylene (HDPE), while the opposing face 2' of the plate 2 is made of polyamide with 30% glass fiber content (PA 66 30FV).

The use of a snowshoe 1 according to the invention is described below with reference, purely by way of example, to the first embodiment of the snowshoe 1 shown in FIGS. 1-9.

The user puts on the snowshoe 1 by inserting his/her foot into the known type of bindings provided, not shown.

The snowshoe 1 starts in the uphill configuration and therefore the structure 4 is in contact with the upper face 2' of the plate 2 and the spikes 3 are free below the plate.

The user begins his/her hike using the breadth of the plate 2 and digging the spikes 3 into the snow so as not to slip during the ascent.

Once the user has reached the end of the uphill stage of the hike, just before starting the descent, or any time that there is a change of slope and he/she possibly has to walk downhill, the user, without releasing his or her foot from the snowshoe 1 bindings, switches the snowshoe to the downhill configuration.

In particular, the user releases the tooth 8 and the first flexible ratchet 9 so as to unhook the structure 4 from the plate 2 and rotates the structure 4 until it is below the lower surface 2" of said plate.

Once the structure 4 has been rotated, it is positioned automatically in such a way that its housings 12 perfectly cover the spikes 3 and the user only needs to re-engage the tooth 8 with the second flexible ratchet 10, re-fastening the structure 4 to the plate 2.

The lower face 2" of the plate 2, covered by the smooth face 4' of the structure 4, is now smooth and ideal for sliding downhill on the snow.

The operation of the snowshoe 1 shown in FIGS. 10-17 is similar, the only difference being that in the first uphill configuration the structure 4 is associated with the lower face 2" of the plate 2, while in the second downhill configuration it is associated with the upper face 2'.

The invention claimed is:

1. A snowshoe (1) comprising:

a plate (2) for resting on the snow and adapted for distributing a user's weight, the plate having an upper face (2'), a lower face (2"), and a main longitudinal extension;

means adapted to fixing, at least partially, the user's foot to the upper face (2') of said plate (2);

a plurality of spikes (3);

a movable structure (4) associated with the plate, the movable structure (4) being rotatable to make said plurality of spikes (3) alternately positioned above and below the lower face (2") of said plate (2), so that i) in a first position, the movable structure (4) defines an uphill configuration of the snowshoe with the spikes showing and ii) in a second position, the movable structure (4) defines a downhill configuration of the snowshoe with the spikes hidden; and a hinge that connects said movable structure (4) to said plate (2), the hinge having an axis of rotation and being located at a tip on an extreme end of the plate (2''') of the plate, the tip (2''') of said plate comprising a slot (6), wherein said movable structure (4) has a shape of a "U" and the axis of rotation of said hinge (5) is arranged transversal with respect to said main longitudinal extension of the plate, wherein said movable structure (4) is switchable from said uphill configuration to said downhill configuration, by said movable structure (4) being turned about said hinge (5), and wherein said hinge (5) includes a pin (7) attached to said movable structure (4) and engaged with said slot (6), said hinge (5) having a variable axis of rotation, which allows for raising or lowering of said movable structure (4) about said hinge (4), where i) upon completion of the upward rotation of said movable structure (4) into the first position, the movable structure (4) and the plate (2) are in contact with one another, and ii) upon completion of the downward rotation of said movable structure (4) into the second position, the movable structure (4) and the plate (2) are in contact with one another.

2. The snowshoe (1) according to claim 1, wherein said plurality of spikes (3) is located on the lower face (2") of said plate (2) and said movable structure (4) is adapted to cooperate with the upper face (2') or lower face (2") of said plate (2) respectively, so as to reversibly cover said plurality of spikes (3).

3. The snowshoe (1) according to claim 2, wherein said movable structure (4) comprises a smooth first face (4') and a second face (4") for housing said plurality of spikes (3).

4. The snowshoe (1) according to claim 3, wherein said movable structure (4) comprises two strips arranged along longitudinal edges of the smooth first face (4').

5. The snowshoe (1) according to claim 1, wherein said lower face (2") of said plate (2) is smooth and said plurality of spikes (3) is located on said movable structure (4) and adapted to cooperate with the upper face (2') and the lower face (2") of said plate (2) respectively, so as to alternately position said plurality of spikes (3).

6. The snowshoe (1) according to claim 5, wherein said plate (2) comprises a central portion (2*a*) for resting stably on the snow and two side wings (2*b*, 2*c*) raised with respect to said central portion.

7. The snowshoe (1) according to claim 6, wherein said plate (2) comprises two strips (17') arranged along longitudinal edges of said central portion (2*a*) and further two strips (17") arranged along longitudinal edges of said side wings (2*b*, 2*c*).

8. The snowshoe (1) according to claim 1, wherein said hinge (5) has a variable axis of rotation.

9. The snowshoe (1) according to claim 8, wherein said hinge (5) comprise a slot (6) associated with said plate (2) and a pin (7) associated with said movable structure (4), wherein the variable position of said axis is defined by said pin (7) moving within said slot (6).

10. The snowshoe (1) according to claim 1, wherein said hinge (5) changes a front part (2''') of said plate (2).

11. The snowshoe (1) according to claim 1, wherein said shape of a "U" of said movable structure (4) comprises two arms (4*a*, 4*b*) and a connecting portion (4*c*), wherein between each of said arms (4*a*, 4*b*) and said connecting portion (4*c*) there is interposed a further hinge (13) with a vertical axis, adapted to allow the rotation in a substantially horizontal plane of the relative arm (4*a*, 4*b*) in order to open the relative arm (4*a*, 4*b*) with respect to an operating position.

12. The snowshoe (1) according to claim 11, wherein between said arms (4*a*, 4*b*) and said connecting portion (4*c*) there are interposed further rotation limitation means (14, 15).

13. The snowshoe (1) according to claim 12 wherein said limitation means comprise a fixed tooth (14) associated with said connecting portion (4*c*) and a rack (15) associated with the respective arm (4*a*, 4*b*).

14. The snowshoe (1) according to claim 1, further comprising restraining means (8, 9, 10) for reversibly fixing said movable structure (4) to said plate (2).

15. The snowshoe (1) according to claim 14, wherein said restraining means comprise:

a tooth (8) associated with said movable structure (4);

a first (9) and a second (10) flexible ratchet associated with said plate (2), adapted to cooperate with said tooth (8) when said movable structure (4) cooperates respectively with said upper face (2') or said lower face (2") of said plate (2).

16. The snowshoe of claim 1, wherein the hinge (5) is located at a tip of the plate (2) located at one end of the plate (2).

17. The snowshoe (1) according to claim 1, wherein between said two arms (4*a*, 4*b*) and said connecting portion (4*c*) there are interposed further rotation limitation means (14, 15).

18. The snowshoe (1) according to claim 17 wherein said further rotation limitation means comprise a fixed tooth (14)

associated with said connecting portion (4*c*) and a rack (15) associated with the respective arm (4*a*, 4*b*).

19. A snowshoe (1) comprising:

a plate (2) for resting on snow and adapted for distributing a user's weight, the plate having an upper face (2') adapted to be positioned under the user's foot, a lower face (2") adapted to be positioned resting on the snow, and a main longitudinal extension, one end of the plate ending with a tip (2'"), said tip including a slot (6);

a plurality of spikes (3) adapted to grip the snow;

a first hinge (5) located at the tip of the plate (2), said first hinge (5) including a pin (7) engaged with said slot (6) of said tip, an axis of rotation of said first hinge (5) being arranged transversal with respect to said longitudinal extension of the plate, the axis of rotation of said first hinge (5) being a variable axis of rotation; and a structure (4) rotatingly connected to the plate (2) by the first hinge (5), the structure (4) being rotatable about said first hinge (5) to make said spikes (3) alternately be positioned above and below the lower face (2") of said plate (2) with said structure (4) in a first position and a second position, where the first position of the structure (4) defines an uphill configuration with the spikes showing and the second position of the structure (4) defines a downhill configuration with the spikes hidden, said structure (4) having a shape of a "U" and comprised of two arms (4*a*, 4*b*) and a connecting portion (4*c*), wherein a mid-portion of the connecting portion (4*c*) includes the tip which is rotatingly connected to the plate (2) by the first hinge (5), wherein the axis of rotation of the first hinge (5) is raised or lowered by rotation of said movable structure (4) about said first hinge (5), where i) upon completion of the upward rotation of said structure (4) into the first position, the movable structure (4) and the plate (2) are in contact with one another, and ii) upon completion of the downward rotation of said movable structure (4) into the second position, the movable structure (4) and the plate (2) are in contact with one another, wherein the variable position of said axis of rotation is defined by said pin (7) being engaged in said slot (6) and movable therewithin to take up either of two end positions with the slot, respectively when the movable structure (4) and the plate (2) are in contact with one another in the first and second positions, and wherein between each of said two arms (4*a*, 4*b*) and said connecting portion (4*c*) there is interposed an additional hinge (13) with a vertical axis, each said additional hinge (13) adapted to allow rotation outward from the longitudinal direction in a substantially horizontal plane of the relative arm (4*a*, 4*b*) in order to open the relative arm (4*a*, 4*b*) with respect to an operating position.

20. A snowshoe (1) comprising:

a plate (2) for resting on snow and adapted for distributing a user's weight, the plate having an upper face (2') adapted to be positioned under the user's foot, a lower face (2") adapted to be positioned resting on the snow, and a main longitudinal extension, one end of the plate ending with a tip (2'"), said tip including a slot (6);

a plurality of spikes (3) adapted to grip the snow;

a hinge (5) located at the tip of the plate (2), said hinge (5) including a pin (7) engaged with said slot (6) of said tip, a variable axis of rotation of said hinge (5) being arranged transversal with respect to said longitudinal extension of the plate; and a structure (4) rotatingly connected to the plate (2) by the hinge (5) and the tip (2'"), the structure (4) being rotatable about said hinge (5) to make said spikes (3) alternately be positioned above and below the lower face (2") of said plate (2) with said structure (4) in a first position and a second position respectively, where i) the first position of the structure (4) defines an uphill configuration with the spikes showing and ii) the second position of the structure (4) defines a downhill configuration with the spikes hidden, said structure (4) having a shape of a "U" and comprised of two arms (4*a*, 4*b*) and a connecting portion (4*c*), wherein a mid-portion of the connecting portion (4*c*) includes the tip which is rotatingly connected to the plate (2) by the pin (7) of the hinge (5), wherein the axis of rotation of the hinge (5) allows for raising or lowering by rotation of said movable structure (4) about said hinge (5), where i) upon completion of the upward rotation of said structure (4) into the first position, the movable structure (4) and the plate (2) are in contact with one another, and ii) upon completion of the downward rotation of said movable structure (4) into the second position, the movable structure (4) and the plate (2) are in contact with one another, wherein the variable position of said axis of rotation is defined by said pin (7) being engaged in said slot (6) and movable therewithin to take up either of two positions, respectively when the movable structure (4) and the plate (2) are in contact with one another in the first and second positions.

* * * * *